US009995456B2

(12) United States Patent
Hansen et al.

(10) Patent No.: US 9,995,456 B2
(45) Date of Patent: Jun. 12, 2018

(54) LED STROBE LIGHT WITH VISUAL EFFECTS

(71) Applicant: Martin Professional ApS, Aarhus N (DK)

(72) Inventors: Claus Ellevang Hansen, Hornslet (DK); Frank Kjaer Jensen, Skødstrup (DK)

(73) Assignee: MARTIN PROFESSIONAL APS, Aarhus N (DK)

( * ) Notice: Subject to any disclaimer, the term of this patent is extended or adjusted under 35 U.S.C. 154(b) by 80 days.

(21) Appl. No.: 15/092,526

(22) Filed: Apr. 6, 2016

(65) Prior Publication Data

US 2016/0305631 A1 Oct. 20, 2016

(30) Foreign Application Priority Data

Apr. 14, 2015 (DK) ..... 2015 70217
Oct. 12, 2015 (DK) ..... 2015 70653

(51) Int. Cl.

| | |
|---|---|
| ***F21V 9/00*** | (2018.01) |
| ***F21V 7/00*** | (2006.01) |
| ***F21S 10/06*** | (2006.01) |
| ***F21V 7/04*** | (2006.01) |
| ***F21S 10/02*** | (2006.01) |

(Continued)

(52) U.S. Cl.

CPC ..... *F21V 7/0083* (2013.01); *F21S 10/023* (2013.01); *F21S 10/06* (2013.01); *F21V 7/005* (2013.01); *F21V 7/0016* (2013.01); *F21V 7/048* (2013.01); *F21V 29/673* (2015.01); *F21V 29/74* (2015.01); *H05B 33/0842* (2013.01); *F21W 2121/00* (2013.01); *F21W 2131/406* (2013.01);

(Continued)

(58) Field of Classification Search

CPC ..... F21V 7/0083; F21V 7/0016; F21V 7/005
See application file for complete search history.

(56) References Cited

U.S. PATENT DOCUMENTS

2007/0024971 A1 2/2007 Cassarly et al.
2008/0259596 A1* 10/2008 Biebl ..... F21V 7/0008 362/228

(Continued)

FOREIGN PATENT DOCUMENTS

| | | | |
|---|---|---|---|
| DE | 20205818 | U1 | 8/2003 |
| WO | 2006086967 | A1 | 8/2006 |
| WO | 2013091654 | A1 | 6/2013 |

OTHER PUBLICATIONS

Danish Search report having application No. PA 2015-70217, dated Nov. 13, 2015.

(Continued)

*Primary Examiner* — Evan Dzierzynski
(74) *Attorney, Agent, or Firm* — Artegis Law Group, LLP

(57) ABSTRACT

The various embodiments relate to a LED strobe lighting fixture comprising a plurality of LEDs arranged in a linear array and which is configured to generate a strobe light effect. The light fixture comprises a central illumination LED array arranged between a first optical reflector and a second optical reflector. At a least one LED pixel array is configured to illuminate at least one of said first optical reflector and said second optical reflector. In one embodiment the LED pixels are configured to illuminate different parts of said first optical reflector or of said second optical reflector.

15 Claims, 8 Drawing Sheets

(51) Int. Cl.

| | |
|---|---|
| ***F21V 29/67*** | (2015.01) |
| ***F21V 29/74*** | (2015.01) |
| ***H05B 33/08*** | (2006.01) |
| *F21W 121/00* | (2006.01) |
| *F21Y 103/10* | (2016.01) |
| *F21Y 115/10* | (2016.01) |
| *F21Y 113/17* | (2016.01) |
| *F21W 131/406* | (2006.01) |

(52) U.S. Cl.
CPC ..... *F21Y 2103/10* (2016.08); *F21Y 2113/17* (2016.08); *F21Y 2115/10* (2016.08)

(56) References Cited

U.S. PATENT DOCUMENTS

| | | | | |
|---|---|---|---|---|
| 2010/0254128 | A1* | 10/2010 | Pickard | F21V 7/0033 362/231 |
| 2013/0286656 | A1* | 10/2013 | Park | F21V 13/02 362/307 |
| 2014/0233231 | A1 | 8/2014 | Howe | |
| 2014/0268747 | A1* | 9/2014 | Demuynck | F21S 9/022 362/235 |

OTHER PUBLICATIONS

Extended European Search Report having Application No. 16 16 5313, dated Aug. 25, 2016, 6 pages.

* cited by examiner

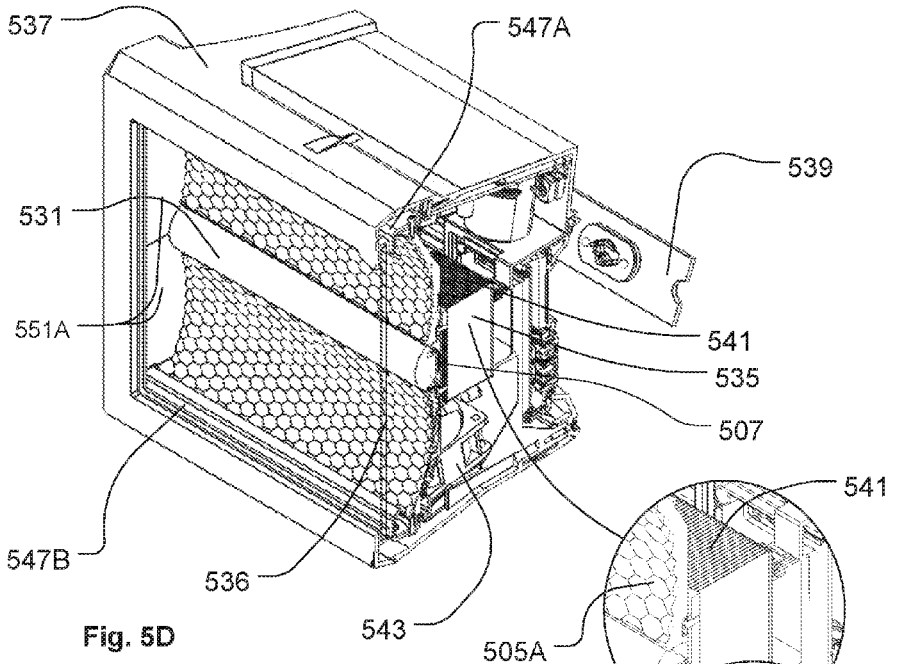
Fig. 5D
Fig. 5F
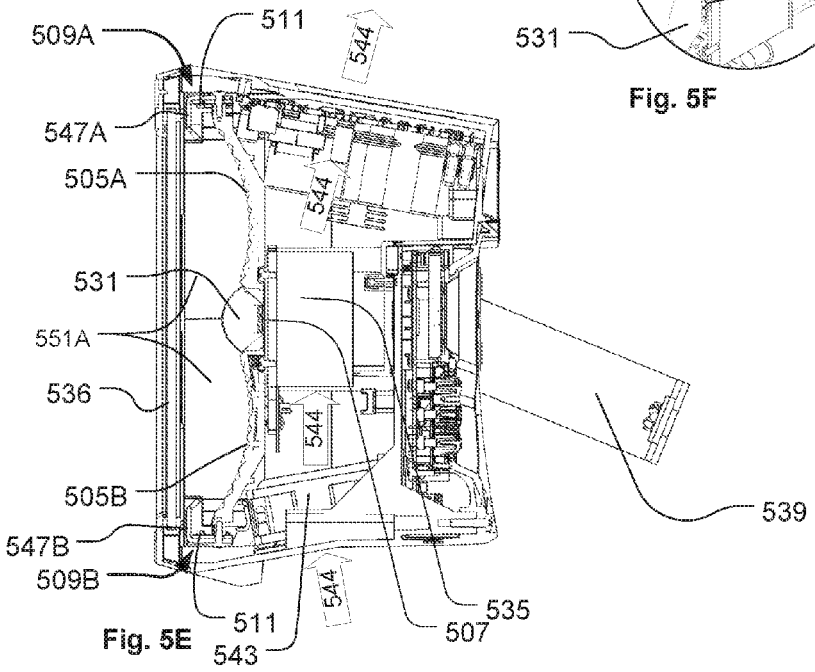
Fig. 5E

LED STROBE LIGHT WITH VISUAL EFFECTS

CROSS-REFERENCE TO RELATED APPLICATIONS

The present application claims priority to the Danish application titled, "LED STROBE LIGHT WITH VISUAL EFFECTS," filed on Apr. 14, 2015 and having application number PA 2015 70217, and to the Danish Application titled, "LED STROBE LIGHT WITH VISUAL EFFECTS," filed on Oct. 12, 2015 and having application number PA 2015 70653. The subject matter of these related applications is hereby incorporated herein by reference.

FIELD OF THE VARIOUS EMBODIMENTS

Various embodiments relate to a LED strobe lighting fixture comprising a plurality of LEDs arranged in a linear array and which is configured to generate a strobe light effect.

BACKGROUND

In order to create various light effects and mood lighting in connection with concerts, live shows, TV shows, sport events or as a part of an architectural installation light fixtures creating various light effects are getting more and more used in the entertainment industry. Typically entertainment light fixtures creates a light beam having a beam width and a divergence and can for instance be wash/flood light fixtures creating a relatively wide light beam or it can be projecting fixtures configured to projecting images onto a target surface.

Strobe light devices are often used in connection with lightshows and serve to generate a very bright light pulse. Strobe light devices can provide bright light pulses of various lengths typical 0-650 ms and a several of strobe rate (typical 0-25 flashes/second)

In many years strobe light for entertainment has been provided with an oblong xenon lamp arranged in an oblong reflector where the reflector is configured to reflect backward emitted light forwardly. This set up has been provided in a rectangular housing with a transparent cover and with the possibility of arranging color gel/filters in front of the lamp in order to provide colored light pulses.

In the field of lighting there has been a tendency to replace the traditional discharge lamps with light emitting diodes (LED) mainly due to energy saving. This tendency have also influence the field of strobe lights and strobe lights based on LEDs have recently been introduced to the market.

LED Strobe light fixtures where a plurality of LEDs have been arranged in a rectangular array and configured to emit light directly into the surroundings as light pulses have recently been introduced. USD702387 shows the ornamental design of such strobe light device where the LED have been provided as an array of 99×30 LEDs and CN3028839595 shows the ornamental design a similar strobe light device with an array of 28×9 LEDs.

LED strobes light where a linear array of LEDs has been arranged in a reflector configured to reflect the light in a forward direction have also recently been introduced. This type of LED strobe light has a similar appearance as the xenon based light strobe lights however cannot provide as much light as the xenon based strobe lights.

U.S. Pat. No. 8,926,122 discloses a stage light fixture comprising a casing, a supporting structure supporting the casing, a light source fitted to the casing and a stroboscopic light source which is fitted integrally to the casing and is substantially annular; wherein the stroboscopic light source comprises at least one substantially semicircular stroboscopic lamp in the form of at least one xenon lamp.

In general the existing LED strobe devices are not cable of providing as much light as the traditional xenon based strobe lights and the uses (light designers and rental companies) are thus not encourage to switch to the more energy and environmental friendly LED based strobe light device especially also due to the fact the LED based strobe light are more expensive that the traditional based xenon based strobe light. From an environmental point of view there is a need for encouraging the uses to switch from the traditional xenon based strobe lights to the more energy and environmental friendly LED based strobe light device.

SUMMARY

One objective of the various embodiments is to solve the above limitation of the known LED based strobe devices and providing a LED based strobe device light fixture which is more appealing to the users and which encourages to switch from traditional xenon based strobe lights to LED based strobe lights. This can be achieved by providing light fixture and method as defined by the independent claims. The benefits and advantages of the various embodiments are disclosed in the detailed description of the drawings illustrating certain embodiments. The dependent claims define different embodiments.

DESCRIPTION OF THE DRAWINGS

FIGS. 5A-5F illustrate different views of a strobe light fixture according to the various embodiments;

DETAILED DESCRIPTION

The contemplated embodiments are described in view of exemplary embodiments intended to illustrate the principles of the various embodiments. The skilled person will be able to provide several embodiments within the scope of the claims. In the illustrated embodiments the illustrated light beams and optical components do only serve to illustrate the principles of the various embodiments rather than illustrating exact and precise light beams and optical components. Throughout the description the reference numbers of similar elements providing similar effects have been given the same last two digits.

Figure 1A:
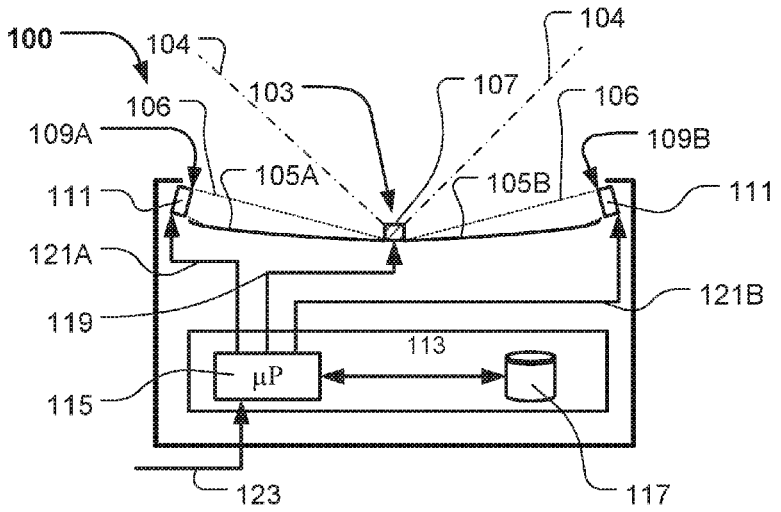
FIGS. 1A and 1B illustrate structural diagrams of a strobe light fixture according to the various embodiments.
Figure 1B:
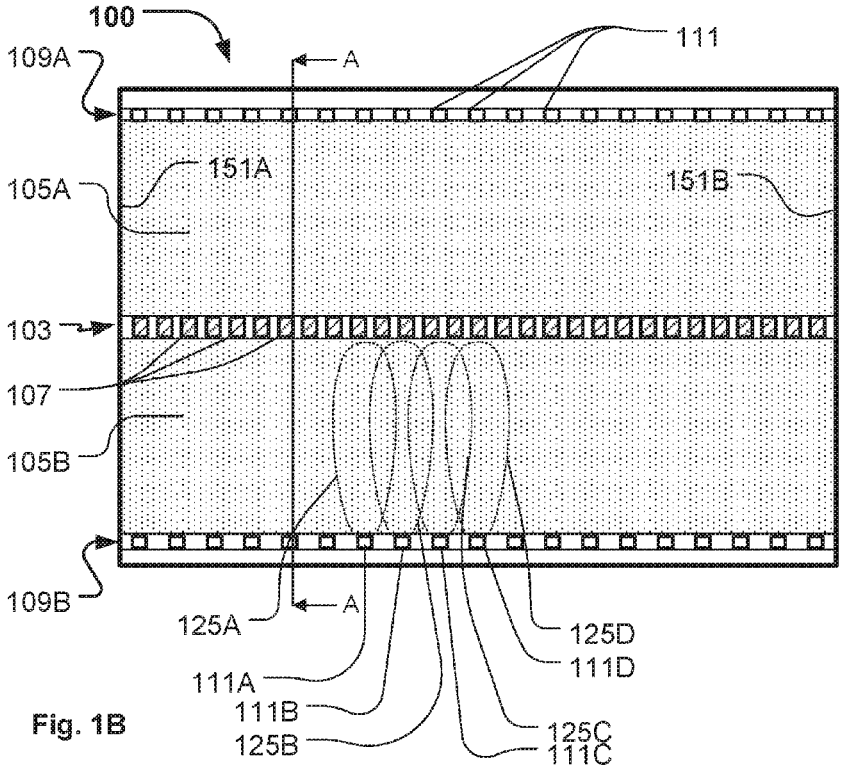

FIGS. 1A and 1B illustrate structural diagrams of a strobe light fixture 100 according to the various embodiments; where FIG. 1B illustrates a front view and FIG. 1A illustrates a cross sectional diagram along line A-A in FIG. 1B. It is noticed the some objects of FIGS. 1A and 1B are shown a block symbols.

The light fixture 100 comprising a central illumination LED array 103 arranged between at least a first optical reflector 105A and a second optical reflector 105B.

The central illumination LED array 103 comprises a plurality of illumination LEDs 107 configured to generate an illumination (illustrated in dashed dotted lines 104) in front of the light fixture. The illumination LEDs can be any kind of light emitting diodes such as solid state LEDs, OLEDs (organic light emitting diodes) or PLEDs (polymer light emitting diodes). The illumination LEDs array 103 is arranged such the light generated by the illumination LEDs 107 will be projected in a forward direction in relation to the light fixture. The illumination LEDs can be single colored LED or multicolored LED comprising a plurality of LED dies emitting different colors, such as 3 in 1 RGB LEDs comprises a red emitter, a green emitter and a blue emitter or 4 in 1 RGBW LEDs comprising a red emitter, a green emitter, a blue emitter and a white emitter. The illumination LEDs 107 can be provided as un-encapsulated LED where the light generated by the LED dies are emitted directly into the surrounding or as encapsulated LED where an optical component have been provided above the LED die. Additionally it is noticed the optical components (not shown in FIG. 1) also can be provided in order to adjust light beam characteristics of the generated light.

The light fixture comprise also a least one LED pixel array 109A, 109B comprising a plurality of individual controllable LED Pixels 111, wherein each of the LED pixels 111 comprises a plurality of light emitters emitting different colors. The LED pixels 111 can be provided as any kind of light emitting diodes such as solid state LEDs, OLEDs (organic light emitting diodes) or PLEDs (polymer light emitting diodes), where each LED pixel comprises a plurality of LED dies emitting different colors. The LED Pixels can for instance be provided as 3 in 1 RGB LEDs which comprises a red emitter, a green emitter and a blue emitter and which is can generating different colors based on additive color mixing where the intensity of the red, green and blue emitter is varied in relation to each other. The at least one LED pixel array 109A, 109B is configured to illuminate at least one of said first optical reflector 105A and said second optical reflector 105B meaning that the light from the LED pixels 111 are configured to emit light onto at least one of the first optical reflector and the second optical reflector. In the illustrated embodiment a first LED pixel array 109A is configured to illuminate (illustrated in dotted lines 106) the first optical reflector 105A and a second LED pixel array 109B is configured to illuminate a second optical reflector 105B. Additionally the LED pixels can be configured to illuminate different parts of said first optical reflector or of said second optical reflector.

The light fixture 100 comprises also a controller 113 comprising a processor 115 and a memory 117. The controller is configured to control the illumination LED array 103 through illumination commutation line 119 and to control the LED pixel arrays 109A, 109B respectively through pixel communication lines 121A and 121B. The controller can for instance be adapted to control the color and/or intensity of the illumination array and/or the LED pixel array and can be based on any type of communication signals known in the art of lightning e.g. PWM, AM, FM, binary signals etc. Additionally the controller 113 is configured to control the LED pixels 111 individually whereby the illumination of different parts of the first 105A optical reflector and the second 105B optical reflector can be controlled by the controller.

It is to be understood that the individually light sources 107 of the illumination LED array 103 can be controlled by the same control signal, supplied with individual control signals and/or grouped in sub-groups where each subgroup receive the same control signal. The illumination communication line 119 and pixel communication lines are illustrated as individual communication lines; however the skilled person will be able to provide many kind of communication means between the controller and the light sources for instance by providing a driver which generates the activation signals for the light sources based on a control signal from the controller. Alternatively the illumination LED array and the LED pixels array can be connected to the same data bus and controlled by the controller through a data bus using addressing. In embodiments where the illumination array comprises a plurality of light sources it is to be understood that the light sources of each group can be controlled based on the same control signal from the controller or controlled by the same driver.

The controller can be adapted to control the illumination LED array and LED pixel array based on respectively an illumination LED control parameter and a LED pixel control parameter. The illumination LED control parameter and the LED pixel control parameter are indicative of at least one parameter defining how the illumination LED array and the LED pixel array should be controlled.

The light illumination LED control parameter can for instance be indicative of intensity/dimming of the illumination LEDs, strobe information such as pulse length and/or strobe rate and/or color of the illumination LEDs.

The LED pixel control parameter can be indicative of how the individual LED pixels 111 shall be controlled and can for instance indicate color, intensity/dimming, and strobe information as strobe rate and pulse length of the individual LED pixels. The LED pixel control parameter can also be indicative of a graphical pattern which the LED pixels shall generate and can for instance be based on a video signal as known in the art of video controlled devices.

The controller can obtain the light illumination LED control parameter and the pixel control parameter from the memory 117 in form of a preprogrammed pattern/light show. In one embodiment the controller is configure to receive the illumination LED control parameter and a LED pixel control parameter from an input signal 123 received from an external source. The input signal 123 can be any signal capable of communication of parameters and can for instance be based on one of the following protocols USITT DMX 512, USITT DMX 512 1990, USITT DMX 512-A, DMX-512-A including RDM as covered by ANSI E1.11 and ANSI E1.20 standards, Wireless DMX, Artnet or ACN designates Architecture for Control Networks; ANSI E1.17, E1.31. The input signal can also be any signal of providing video signals such as composite video, HDMI, NTSC, S-Video, SECAM, HDBAseT, etc. The P3 video protocol provided by the applicant Martin Professional can also be used to provide video signal to the light fixture. In one embodiment the light fixture is configured to receive the illumination LED control parameter through a light control protocol and to receive the LED pixel control parameter through a video control protocol.

LED control parameter and the pixel control parameter can also be generated from user input means either implemented as a part of the projecting light fixture or implemented on an external controller which sends the light source control parameter to the projecting light fixture through an input signal.

By providing a central illumination LED array which is arranged between a first optical reflector and a second optical reflector, where at least one LED pixel array is configured to illuminate different parts of the optical reflector makes is possible to provide a light fixture which can generate a very bright light beam for illumination purposes by using the central LED illumination array and in addition also provide a visual light effect as the LED pixel array illuminates the optical reflector besides the central illumination LED array. The optical reflectors reflect the light generated by the LED pixels forwardly and the optical reflector appears thus as a visual illuminating object. As a consequence is possible to provide a LED strobe light fixture with additional light effects which encourages the user to switch from the known Xenon based strobe lights whereby the energy consumption is reduced. The central illumination device can for instance be embodied as a linear LED array having a length which is at least twice as long as it's width and it is thus possible to imitate the look of a xenon strobe light which as a linear light emitter. In addition hereto the optical reflectors can be arrange along the longest sides of the linear illumination LED array and the LED strobe device will thus appear as xenon strobe light fixture. In addition hereto additional visual effects can be provided by illuminating the optical reflectors using the LED pixel array. The various embodiments thus provide an additional effect to LED strobe devices.

In the illustrated embodiment the LED pixels are configured to illuminate different parts of the first optical reflector or of the second optical reflector. This is illustrated by the dashed lines 125A-125D which illustrates different parts of the optical reflectors illuminated the corresponding LED pixel. LED pixel 111A illuminates part 125A, LED pixel 111B illuminates part 125B, LED pixel 111C illuminates part 125C and LED pixel 111D illuminates part 125D. The illumination from the different LED pixels may partially overlap and thus partially illuminate the same parts of the optical reflector. The fact that the LED pixels are individual controllable and illuminates different parts of the optical reflector makes it possible to create a dynamic light effect at the optical reflector as the illumination created by the individual LED pixels can be dynamically changed. As a consequence a very nice light effect can be created.

In addition the light fixture may optionally comprises at least one end reflection surface 151A, 151B arranged adjacent to at least one of the first optical reflector 105A and the second optical reflector 105B. Such end reflection surface can be used to reflect some of the light illuminating the first and/or the second optical reflector in a forward direction and thus appears as an additional illumination surface when observed from the front of the light fixture. An end reflection surface thus enhances the additional visual effect provided by the LED pixel array illuminating the first and second optical reflectors.

In the illustrated embodiment the light fixture comprises a first end refection surface 151A and a second end reflection surface 151B constituting the inner part of the side walls of the light fixture, where the reflection surfaces can be provided as a regular mirror attached to the inner surface of the side walls, a reflecting coating applied to inner surface of the side walls, a reflecting foil arranged at the side wall, a polished metal sheet or by providing the inner side walls as a polished metal. The reflecting end surfaces can thus be provided as separate objects arranged inside the light fixture or form part of the side walls of the light fixture.

The at least one end reflector is configured to receive at least a part of the light illuminating at the first optical reflector and/or the said second optical reflector and is arranged at a position visible from the front side of said light fixture. A person looking at the light fixture from a position where the end reflection surface is visible will thus see the end refection surface as an additional illumination surface which can enhance the additional visual effect created by the LED pixels' illumination of the first optical reflector and/or the second optical reflector. The end reflecting surfaces can for instance be provided as a mirror surface providing an image of the first optical reflector and/or the second optical reflector and a person will see this as the first and/or second optical reflectors continuous outside the light fixture. The end surface can for instance be provided as a plane surface providing a mirror image of the first and/or second reflector to a person observing the end reflection surface. Additionally it is noticed the end reflection surface can be provided with a curvature in order to provide magnified or demagnified image of the first and/or second optical reflectors additionally the curvature can be configured to provide a special deformation of the mirror image of the first and or second optical reflectors.

In one embodiment the two end reflection surfaces are arranged at opposite sides of the first reflector and/or the said second optical reflector and the two end reflector surfaces are configured to face each other. As a consequence multiple reflections between the two reflection surfaces facing each other can be provided, which creates the impression that the first and/or second optical reflectors continuous outside the light fixture in infinite length. This effect is especially visible when a person observes the light fixture form an acute side angle.

In one embodiment at least one of the end refection surfaces is angled in relation to the front of the light fixture whereby at light reflected by the end reflectors are reflected in a more forward direction and thereby makes the enhancement of the additional visual effect provided by the LED pixel array illumination of the first and second optical reflectors visible form a larger amount of positions in front of the light fixture. The end surface reflectors may be provided at an angle in the interval 70 to 90 degrees in relation the front surface of the light fixture.

Figure 2A:
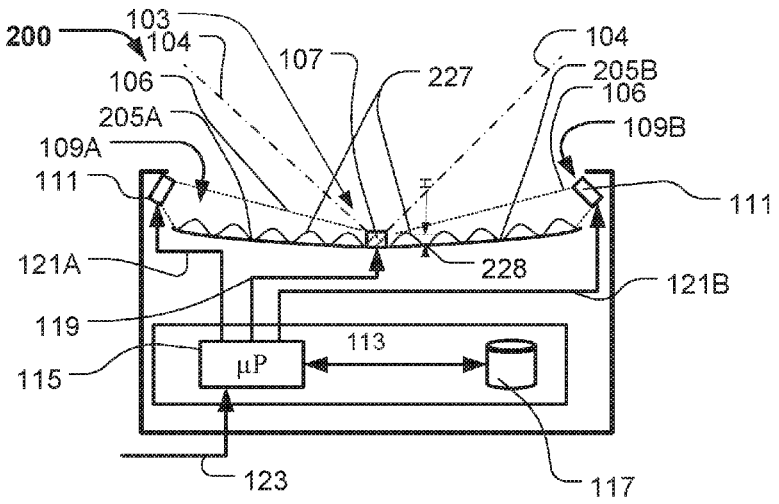
FIGS. 2A and 2B illustrate a structural diagram of another embodiment of a strobe light fixture according to the various embodiments.
Figure 2B:
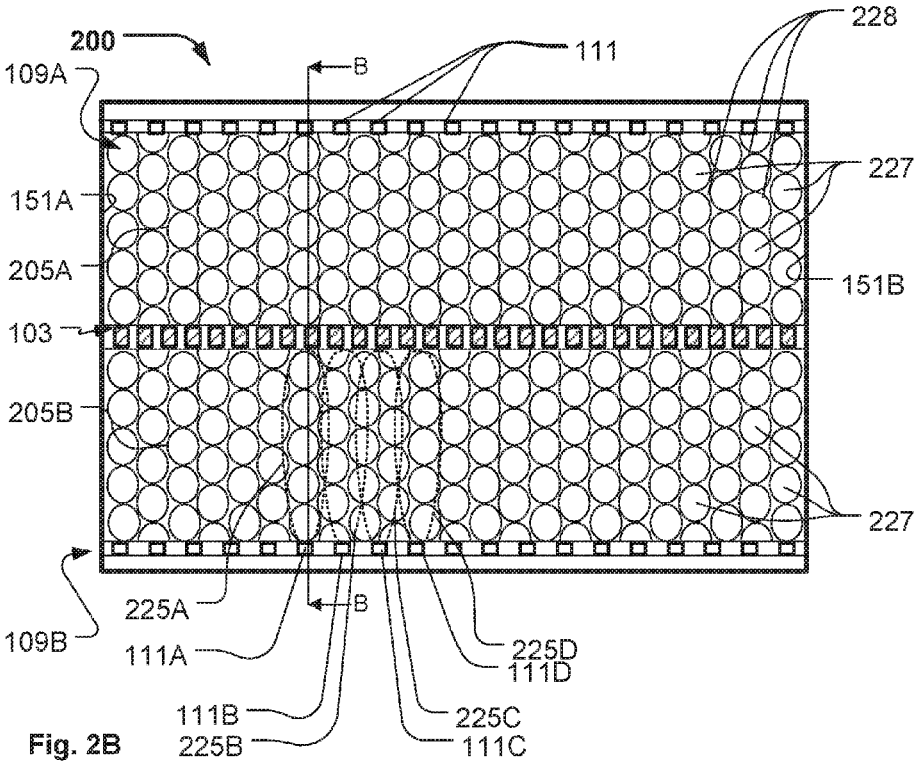

FIGS. 2A and 2B illustrate structural diagrams of a strobe light fixture 200 according to the various embodiments; where FIG. 2B illustrates a front view and FIG. 2A illustrates a cross sectional diagram along line B-B in FIG. 2B. It is noticed the some objects of FIGS. 2A and 2B are shown as block symbols.

The light fixture 200 is similar to the light fixture 100 illustrated in FIGS. 1A and 1B and identical components are labeled with the same references as in FIGS. 1A and 1B and will not be described further in connection with FIGS. 2A and 2B. FIGS. 2A and 2B serve to illustrate further aspects according to the various embodiments and it is to be understood the illustrated principles can be combined with any of the illustrated embodiments.

In this embodiment the first optical reflector 205A and the second optical reflector 205B comprises a plurality of individual specular reflectors 227, where the individual specular reflectors are regions of the first optical reflector and/or the second optical reflector which can reflect incident light as described by the law of refraction. Additional the term individual specular reflectors mean that a human observing the individual specular reflectors during illumination of the individual specular reflectors will be able to distinguish the individual secular reflectors from each other. This can for instance be achieved by providing the individual specular reflectors as a plurality of specular ripples or specular facets, the specular ripples can be provided as depressions or elevations in the surface of the first and/or second optical reflector such as dents, dimples humps, bumps or the like. The individual specular reflectors can also be provided as a plurality of specular facts defining substantial flat specular surfaces which have been angled in relation to the neighboring surfaces. Additionally the individual specular reflectors can be provided by providing non-reflective boundaries between the individual specular reflectors whereby a human observer will see the non-reflective boundaries separating the individual reflectors, as the boundaries of the individual specular reflector will appears as regions with less light.

The addition of the plurality of individual specular reflectors 227 to the first optical reflector 205A and/or the second optical reflector 205B results in the fact that a human observer will observer the surface of the first and/or second optical reflector as a plurality of separate individual illumination objects and thus create a visual light effect at the first and/or second optical reflector.

The LED pixels can be configured to illuminate different ones of the individual specular reflectors. This is illustrated by the dashed lines 225A-225D which illustrates which one of the individual specular reflectors is illuminated by the corresponding LED pixels 111A-111D. LED pixel 111A illuminates part 225A, LED pixel 111B illuminates part 225B, LED pixel 111C illuminates part 225C and LED pixel 111D illuminates part 225D. The illumination from the different LED pixels may partially overlap and thus partially illuminated the same parts of the optical reflector. The fact that the LED pixels are individual controllable and illuminates different parts of the optical reflector makes it possible to create a dynamic light effect at the optical reflector as the illumination created by the individual LED pixels can be dynamically changes. Additionally since the LED pixels illuminate different specular reflectors makes it possible to provide a reflective surface where each of the individual specular reflectors primarily reflects light form a corresponding LED pixel as consequence that individual reflector will illuminate like the LED pixel primarily illuminating the LED pixel. In embodiments where each of the LED pixel is configured to illuminate a plurality of the individual specular reflectors results in the fact the each LED pixel is mapped into a plurality of illuminating pixels at the optical reflector, this is achieved as the human observer will observe each of the individual reflectors as a pixel, where the group of individual reflectors illuminated by the same LED pixel will be illuminated in the same way. In this way the first and second optical reflectors can simulate a LED pixel device with a higher number of pixels in spite of the fact that only a small number of LED pixels are provided in the LED pixel array.

In FIGS. 2A and 2B the individual specular reflectors are formed a plurality of individual specular humps provided at the first and second optical reflector. The front view illustrates that the individual specular reflectors are arranged in a regular pattern meaning the at least at some of the individual specular reflectors are at regular intervals in relation to each other. The highest point of each individual specular hump is elevated at least 1 mm in relation to the part 228 separating the individual specular hump form the neighboring individual specular hump. The height H of the humps influences the visual appearance of the optical reflector when illuminated by the LED pixels. This is achieved as the height of the humps influence how the lights is reflected forwardly and how the shadow effects, that is created by the humps at the optical reflectors, appears. If the height of the humps is too small the visual effect provided by the LED pixels and the individual specular humps are reduced. In particular the height of the individual specular humps should be at least 1.5 mm in relation the part separating the individual specular humps form the neighboring individual specular humps. Additional too height humps may result in the effect that humps starts to cast to dominant shadows at the optical reflector which can provide a less attractive illumination of the optical reflectors. Thus in one embodiment the height of humps is elevated less than 3 mm in relation to the part separating the humps form the neighboring humps.

As described above the light fixture can optionally comprises a first end refection surface 151A and a second end reflection surface 151B configured to receive at least a part of the light illuminating at the first optical reflector and/or the said second optical reflector and is arranged at a position visible from the front side of said light fixture. The visual effect created by the specular ripples (dents, dimples humps, bumps or the like) of the first and/or second optical reflector can thus be enhanced by the end refection surfaces.

Figure 3A:
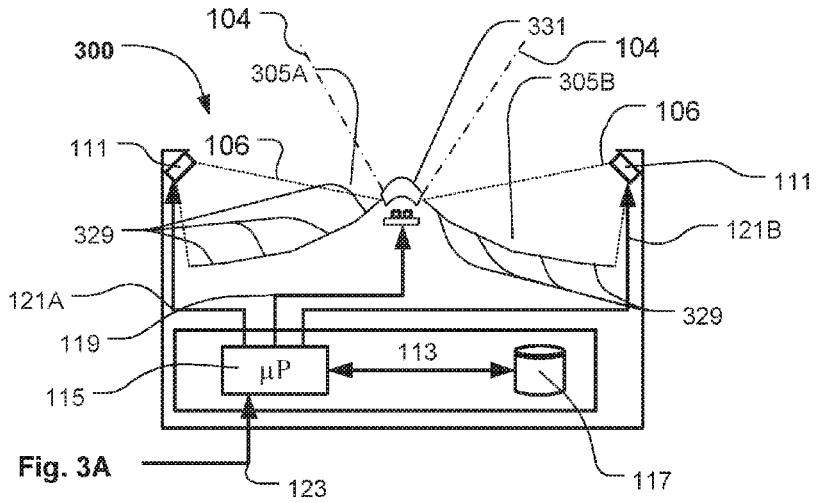
FIGS. 3A, 3B and 3C illustrate a structural diagram of another embodiment of a strobe light fixture according to the various embodiments.
Figure 3B:
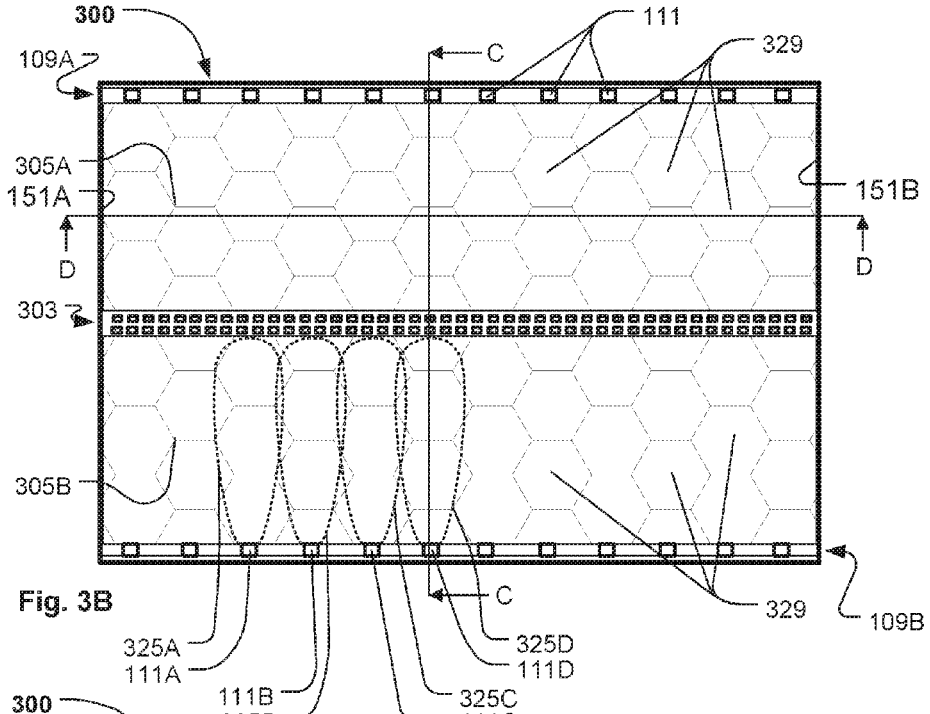
Figure 3C:
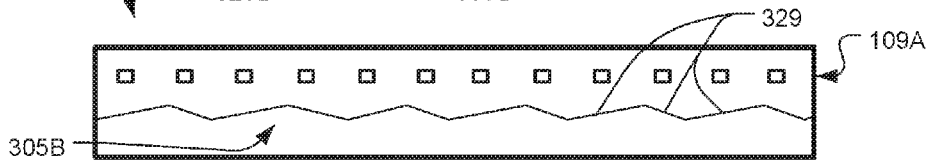

FIGS. 3A, 3B and 3C illustrate structural diagrams of a strobe light fixture 300 according to the various embodiments; where FIG. 3B illustrates a front view, FIG. 3A illustrates a cross sectional diagram along line C-C in FIG. 3B and FIG. 3C illustrates a cross sectional diagram along line D-D in FIG. 3B. It is noticed the some objects of FIGS. 3A, 3B and 3C are shown a block symbols instead of illustrations.

The light fixture 300 is similar to the light fixtures 100 and 200 respectively illustrated in FIGS. 1A-B and 2A-B. Identical components are labeled with the same references as in FIGS. 1A-B and 2A-B and will not be described further in connection with FIGS. 3A and 3B. FIGS. 3A and B serve to illustrate further aspects of the light fixture according to the various embodiments and it is to be understood that the illustrated principles can be combined with any of the other embodiments illustrated in this patent application.

In the embodiment the illustrated in FIGS. 3A, 3B and 3C the individual specular reflectors are formed as a plurality of faceted specular surfaces 329. As can be seen in FIGS. 3A and 3C the faceted specular surfaces 329 have different angels in relation to the front plane of the light fixture, as a result the light hitting the faceted specular surface is reflected in different direction which results in a visual light effect at the first and second optical reflector.

FIG. 3A does also illustrate that it is possible to provide a light collector 331 which is configured to collect light from the illumination LED array and convert the collected light into a light beam having emitting characteristics such as beam widths light divergence, which at least is determined by the light collector 331. In general the light collector can be any optical component capable of collecting light and converting the collected light into a light beam, such optical component can for instance be optical lenses, TIR lenses, light mixing rods etc. or combinations thereof. In general the light collector can be configured to collect light for only one of the illumination LEDs, a sub-group of illumination LEDs or all of the illumination LEDs. In the illustrated embodiment the light collector is provided as a linear solid lens comprising an entrance surface facing the LEDs where the light from the illumination LEDs enters the light collector. The linear solid lens comprises an exit surface where through the light is emitted.

According to another aspect of the various embodiments the illumination LED array, the light collector and the first and second optical reflectors have been mutually arranged such that substantially no light from the illumination LED array will illuminate the optical reflectors. A consequence of this arrangement is the fact substantially no light from the illumination LED array will be mixed with light from the LED pixels at the optical reflectors whereby the light from the LED pixel array will be the dominant illumination at the optical reflector. This makes it easier to control the illumination and the light effect at the optical reflectors as there is no need to take eventual light contribution from the illumination LED array into account when creating the illuminations and light effect at the optical reflector. That substantially no light from the illumination LED array means that no more than 10% of the light generated by the illumination LED array will hit the optical reflectors. Thus the illumination LED array, the light collector and the optical reflectors have been mutually arranged such that at most 10% of the light generated by the illumination LED array will illuminate to optical reflector. In another embodiment at least 90% of the light illuminating the optical reflector originates from the LED pixel array, which ensures that the light for from LED pixel array dominates at the optical reflector.

The LED pixels are configured to illuminate different parts of the first optical reflector or of the second optical reflector. This is illustrated by the dashed lines 325A-325D which illustrate different parts of the optical reflectors illuminated the corresponding LED pixel. LED pixel 111A illuminates part 325A, LED pixel 111B illuminates part 325B, LED pixel 111C illuminates part 325C and LED pixel 111D illuminates part 325D.

Additionally the central illumination LED array 303 has been provided as a central linear illumination LED array comprising two rows of illumination LEDs arranged side by side. It is to be understood that central illumination LED array 303 can be provided with any positive number of rows of illumination LEDs where the rows comprises any with any positive number of illumination LED. By providing the central LED array as a linear LED illumination array makes it possible to imitate a traditional xenon based strobe light which is linear. This can be achieved by providing a linear illumination LED array where the ration between the length and width of the linear illumination LED array is at least 2:1, meaning the length is at least two times bigger than width. The first optical reflector and the second optical reflector are then arranged along the length of the linear LED array and at opposite sides. In a more specific embodiment the ration between the length and width of the linear illumination LED array is at least 4:1, meaning the length is at four times longer than the width. In a yet more specific embodiment the ration between the length and width of the linear illumination LED array is at least 10:1, meaning the length is at ten times longer than the width.

As described above the light fixture can optionally comprises a first end refection surface 151A and a second end reflection surface 151B configured to receive at least a part of the light illuminating at the first optical reflector and/or the said second optical reflector and is arranged at a position visible from the front side of said light fixture. The visual effect created by the specular facets of the first and/or second optical reflector can thus be enhanced by the end refection surfaces.

Figure 4A:
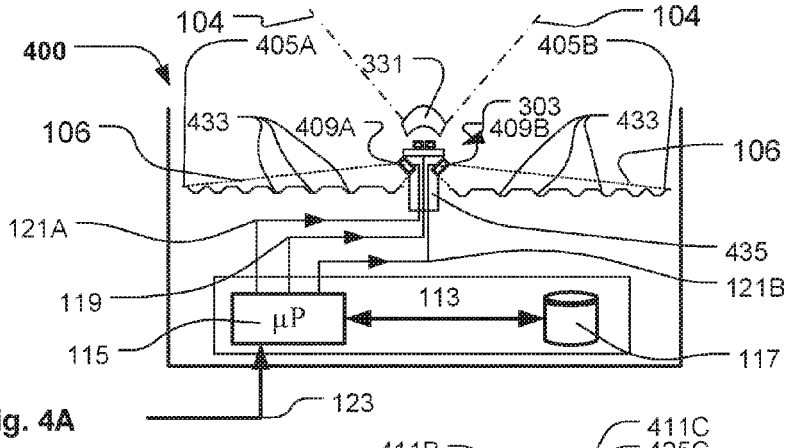
FIGS. 4A, 4B and 4C illustrate a structural diagram of another embodiment of a strobe light fixture according to the various embodiments.
Figure 4B:
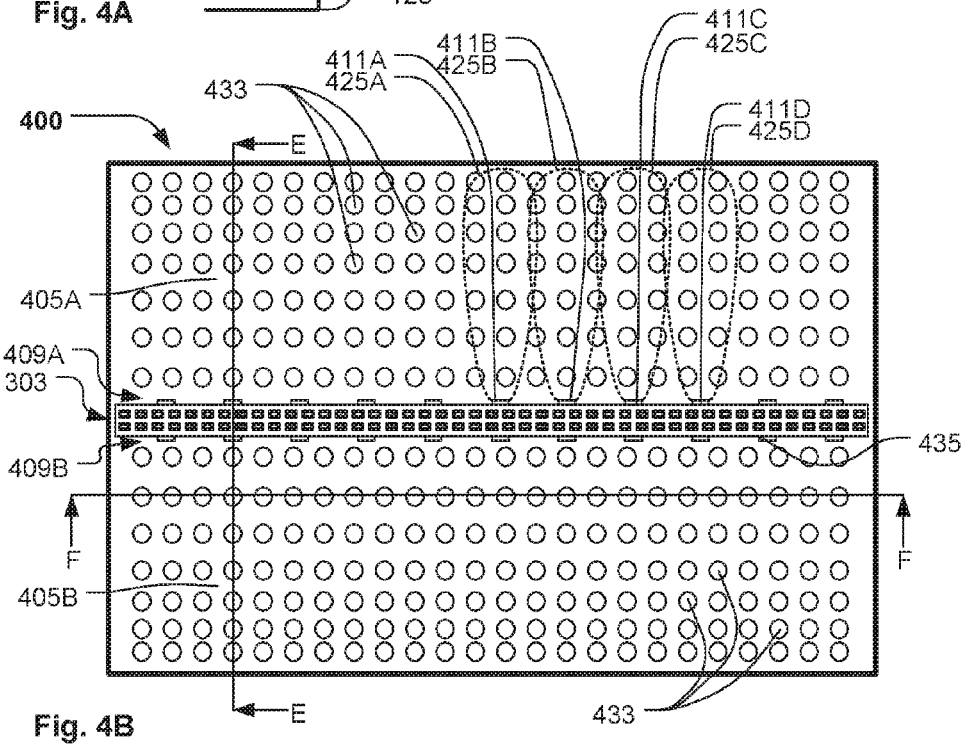
Figure 4C:
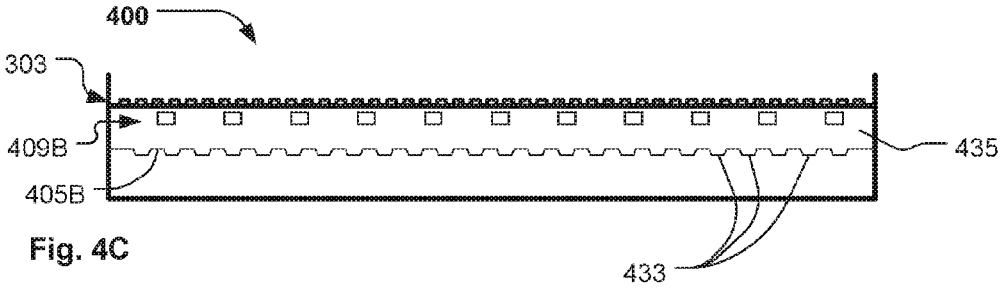

FIGS. 4A, 4B and 4C illustrate structural diagrams of a strobe light fixture 400 according to the various embodiments; where FIG. 4B illustrates a front view, FIG. 4A illustrates a cross sectional diagram along line E-E in FIG. 4B and FIG. 4C illustrates a cross sectional diagram along line F-F in FIG. 4B. The light fixture 400 is similar to the light fixtures 100, 200, 300 respectively illustrated in FIG. 1A-B, 2A-B, 3A-C. Identical components are labeled with the same references as in the previous figures and will not be described further in connection with FIG. 3A-3C. FIGS. 3A-C serve to illustrate further aspects of the light fixture according to the various embodiments and it is to be understood the illustrated principles can be combined with any of the other embodiments illustrated in this patent application.

In the embodiment the illustrated in FIGS. 4A-C the individual specular reflectors are formed as a plurality of specular dimples 433. As can be seen in FIG. 4B the dimples 433 have been proved at regular intervals along the length of the light fixture and at varying intervals along the width of the light fixture, where the distance between the dimples decreases from the middle and outwards. The dimples provided a visual effect and the decreased distance between the dimples results in the fact the visual appearance of the illuminated first and second optical reflector is varied across the light fixture. It is noticed that in general the specular reflector can be provided in any desired pattern (regular, randomly or combinations thereof) in order to provide a desired visual effect when illuminating the first and second optical reflectors.

Additionally the first 409A and second 409B LED pixel array are arranged in the middle part of the light fixture and illuminate respectively the first 405A and second 405B optical reflectors from the central part and outwards. In the illustrated embodiment the first 409A and second 409B LED array are arranged on the same heat sink 435, where the central illuminations LED array 303 have been arranged at the top of the heat sink and where the first 409A and second 409B LED pixel array have been arranged at the sides of the heat sink.

Additionally it is also noticed that the principles illustrated in FIG. 4A-4C also can be applied to light fixtures where the specular reflectors are provided as any kid of specular reflectors such as ripples, humps or facets and thus not limited to optical reflectors where the specular reflectors are provided as dimples.

Figure 5A:
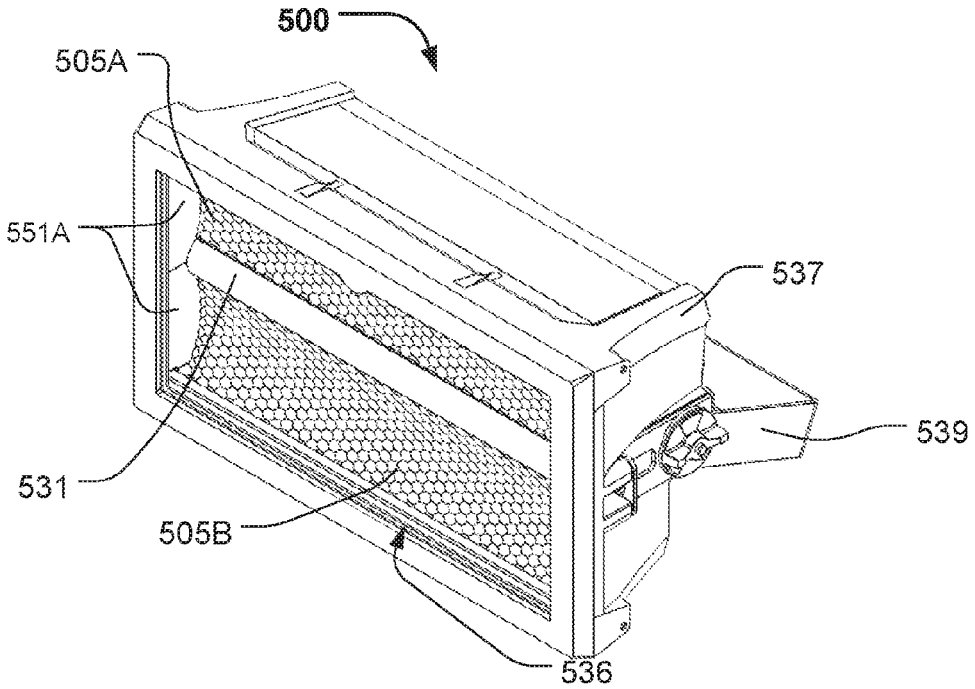
Figure 5B:
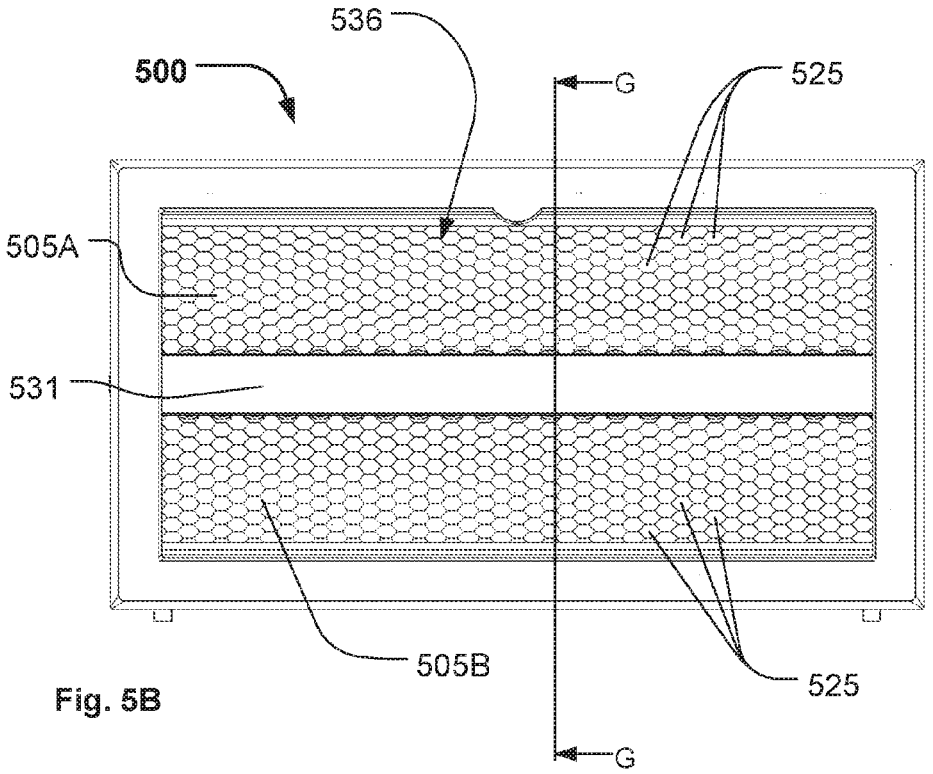
Figure 5C:
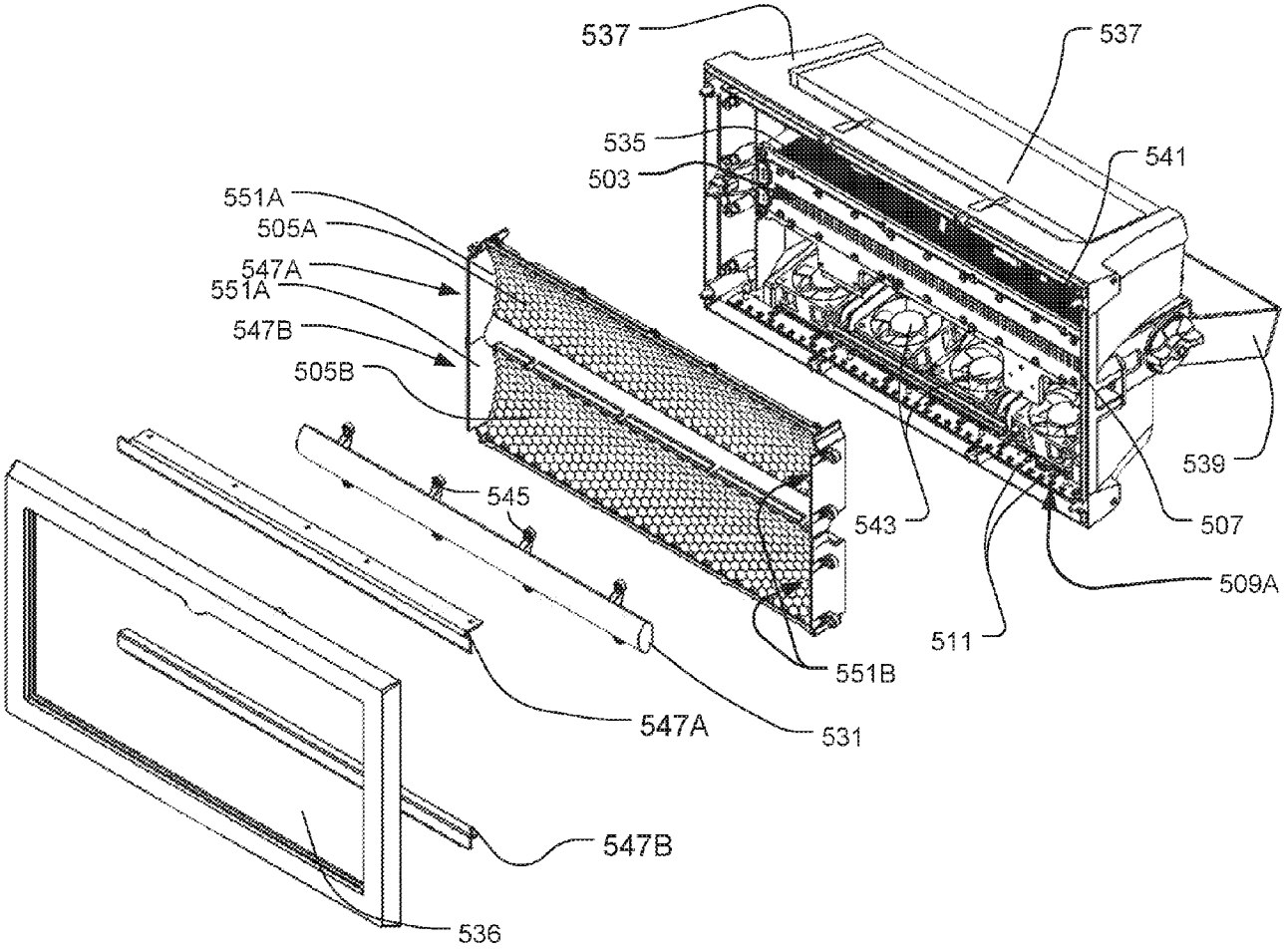

FIGS. 5A-5F illustrate an embodiment of a strobe light fixture 500 according to the various embodiments; where FIG. 5A illustrates an isometric front view, 5B illustrates a front view, FIG. 5C illustrates an exploded isometric front view, FIG. 5D illustrates isometric cross section view and FIG. 5E illustrates an isometric cut away along line G-G of FIG. 5B, FIG. 5E illustrates a line cross sectional view along line G-G in FIG. 5B, and FIG. 5F illustrate an enlarged view of the central heat sink 535.

The light fixture comprises a housing 537 wherein the components are arrange and the housing comprises a mounting bracket 539 (optional) for arranging the light fixture in a light installation. The light fixture comprises a central linear illumination LED array 503, a first 509A and a second 509B LED pixel array, a first 505A and a second 505*b* optical reflector, a linear light collector 531 and a transparent front surface 536.

The central linear illumination LED array 503 is arranged between a first optical reflector 505A and a second optical reflector 505B. The central illumination LED array 503 comprises a plurality of illumination LEDs 507 configured to generate an illumination light effect in front of the light fixture. The illumination LEDs 507 is arranged on a central heat sink 535 comprising a number of cooling fins 541. At least one blower 543 is arrange inside the housing and is configure to blow cooling air from the outside of the light fixture onto the heat sink 535 in order to remove heat from the illumination LEDs and then the cooling air leaves the light fixture through a number of openings in light fixture. Arrows 544 in FIG. 5E illustrates the air flow through the light fixture where after blower 543 sucks air into the light fixture through opening near the blowers. The cooling air then flow through openings between the cooling fins and out of the light fixture though openings at the other side of the light fixture.

A linear light collector 531 is arranged above the illuminations LED array and is configured to collect light from the illumination LEDs and convert the collected light into a light beam which is emitted in a forward direction in relation to the light fixture. The linear solid lens comprises an exit surface where through the light from the illumination LEDs is emitted. In the illustrated embodiment the illumination LED array, the light collector and the first and second optical reflectors have been mutually arranged such that substantially no light from the illumination LED array will illuminate the optical reflectors. The linear light collector is provided as a molded lens are and a plurality of support leg 545 have been integrated into the light collector. The support legs 545 are configured to be secured to the heat sink whereby the linear light collector is arranged above the illumination LEDs.

The first 509A and second 509B LED pixel arrays comprise a plurality of individual controllable LED pixels 511, wherein each of the LED pixels 111 comprises a plurality of light emitters emitting different colors. The first and second LED pixel arrays are respectively configured to illuminate the first and second optical reflectors and the LED pixels are configured to illuminate different parts of said first optical reflector or of said second optical reflector. In the illustrated embodiment the first 509A and the second 509B LED array are respectively arranged on a first 547A and second 547B elongated support member. The first and second elongated support members are provided as a nearly L-shaped metal extrusion and arranged such one leg of the L-shaped metal extrusion are mounted parallel with respectively the first optical reflector and the second optical reflector. The LED pixel arrays are arranged on the leg which is parallel with the optical reflectors. The L-shape metal extrusions are arranged such the other leg extends inwardly in relation the sides of the housing and arranged above the LED pixels arrays. The second leg are configured to reflect a part of the light from the LED pixels towards the optical reflector and prevents also light from the LED pixels to be emitted forwardly, as a consequence substantially all light from the LED pixels are configured to illuminate the optical reflectors. In FIG. 5C the elongate support members are exploded without exploding the LED pixels. It is noticed that the elongate support members can be provided in many various shapes. The second leg of the elongated support member can also be formed in various shapes for instance in order to reflect the light from the LED pixels in a specific way towards the optical reflectors. It also noticed that LED Pixel optics can be provided which is configured to collect and modify the light from one of more of the LED pixels in a desired way, such LED pixel optics can be provided as optical lenses, TIR lenses, light mixers etc.

The light fixture comprises a controller (not shown) for controlling the linear central LED array and LED pixel arrays as described with the previous figures and these principles will not be described further in connection with FIG. 5.

The first 505A and second 505B optical reflectors are provided as two molded reflector structures 547 wherein the first and second optical relectors are integrated. In the illustrated embodiment the molded reflector structures are molded in polymer and the optical rectors are provided by coating the surfaces that forms the optical reflectors with a reflective coating. In the illustrated embodiment the optical reflectors comprises a plurality of individual speculate reflectors 525 where the individual specular reflector are formed as a plurality specular humps arranged in a hexagonal pattern. This pattern provides a good optical effect. The height of the humps increases towards the center and each hump is thus highest at the center. The highest point of each hump is elevated at least 1 mm in relation to the part separating the hump form the neighboring hump. The height of the humps influences the visual appearance of the optical reflector when illuminated by the LED pixels this is achieved as the height of the humps influence how the lights is reflected forwardly and how many shadow effects that is created by the humps at the optical reflectors. If the height of the humps is too small the visual effect provided by the LED pixels are reduced. In particular the height of the humps should be at least 1.5 mm in relation the part separating the hump form the neighboring humps. Additional too height humps may result in the effect that humps starts to cast to dominant shadows at the optical reflector which can provide a less attractive illumination of the optical reflectors. Thus in one embodiment the height of humps is elevated less than 3 mm in relation to the part separating the humps form the neighboring humps.

Optionally a first end refection surface 551A and a second end reflection surface 551B may been formed in each of the two molded structures by coating the side structures adjacent the first and second optical reflectors with a reflective coating. As described above the first and second end refection surfaces are configured to receive at least a part of the light illuminating at the first optical reflector and/or the said second optical reflector and is arranged at a position visible from the front side of said light fixture. The visual effect created by illumination of the humps of the first and/or second optical reflector can thus be enhanced by the end refection surfaces.

As described above the light fixture comprises a first end refection surface 451A and a second end reflection surface 451B configured to receive at least a part of the light illuminated at the first optical reflector and/or the said second optical reflector and is arranged at a position visible from the front of said light fixture. The visual effect created by structures of the first and/or second optical reflectors can thus be enhanced by the end refection surfaces.

Figure 6A:
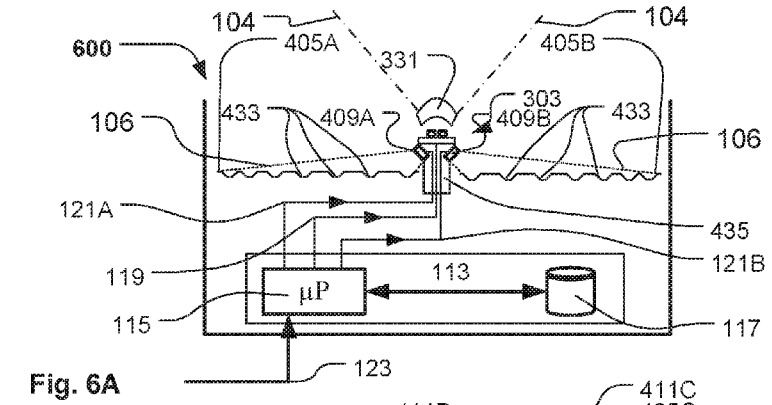
FIGS. 6A, 6B and 6C illustrate a structural diagram of another embodiment of a strobe light fixture according to the various embodiments.
Figure 6B:
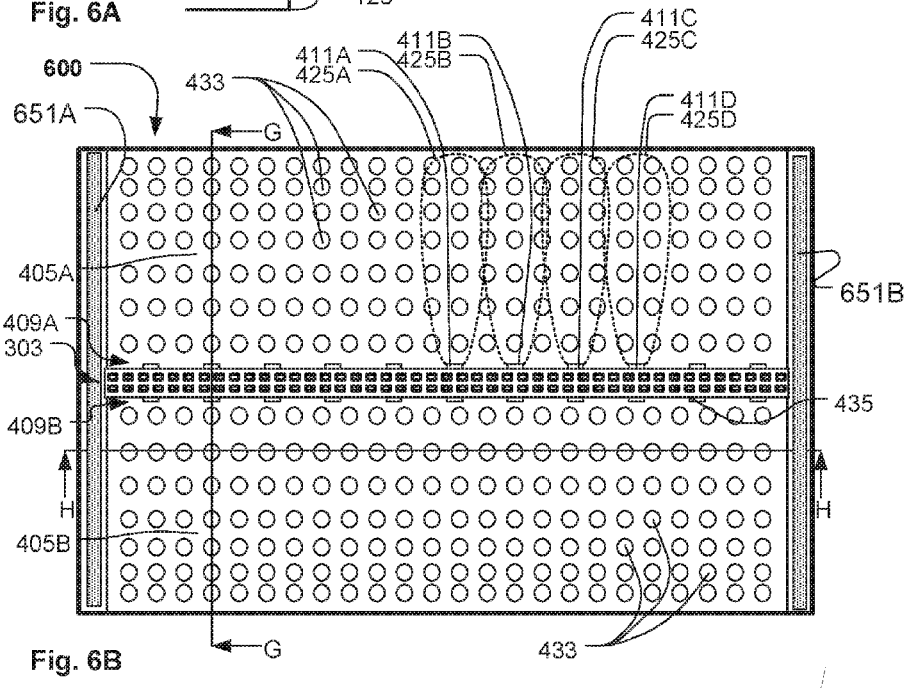
Figure 6C:
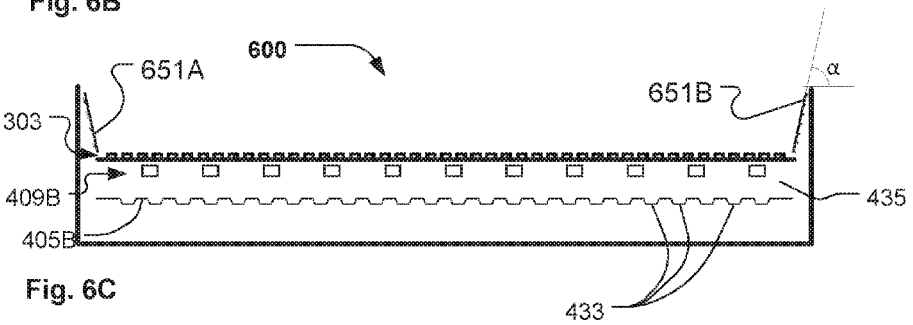

In this embodiment the end refection surfaces 451A, 451B are angled in relation to the front of the light fixture whereby light reflected by the end reflectors are reflected in a more forward direction and thereby make the enhancement of the additional visual effect created by illumination of the structures of the first and/or second optical reflectors visible form a larger amount of positions in front of the light fixture. The end surface reflectors may be provided at any angle, $\alpha$, in the interval 70 to 90 degrees in relation to the front surface of the light fixture, as in this in this interval of angles a good compromise between the areas of the first or second optical reflectors from which the end reflectors received light and the possible viewing positions in front of the light fixture is achieved FIGS. 6A, 6B and 6C illustrate structural diagrams of the strobe light fixture 600; where FIG. 6B illustrates a front view, FIG. 6A illustrates a cross sectional diagram along line G-G in FIG. 6B and FIG. 6C illustrates a cross sectional diagram along line H-H in FIG. 6B. The light fixture 600 is a modified embodiment of the strobe light fixture 400 illustrated in FIGS. 4A-C. Identical components are labeled with the same references as in FIGS. 4A-C and will not be described further in connection with FIG. 6A-6C. FIGS. 6A-C serve to illustrate further aspects of the light fixture according to the various embodiments and it is to be understood the illustrated principles can be combined with any of the other embodiments illustrated in this patent application.

In this embodiment the light fixture comprises a first end refection surface 651A and a second end reflection surface 651B configured to receive at least a part of the light illuminated at the first optical reflector and/or the second optical reflector and is arranged at a position visible from the front of said light fixture. The visual effect created by structures of the first and/or second optical reflectors can thus be enhanced by the end refection surfaces.

In this embodiment the end refection surfaces 651A, 651B are angled in relation to the front of the light fixture whereby light reflected by the end reflectors are reflected in a more forward direction and thereby make the enhancement of the additional visual effect created by illumination of the structures of the first and/or second optical reflectors visible form a larger amount of positions in front of the light fixture. The end surface reflectors may be provided at any angle, $\alpha$, in the interval 70 to 90 degrees in relation to the front surface of the light fixture, as in this in this interval of angles a good compromise between the areas of the first or second optical reflectors from which the end reflectors received light and the possible viewing positions in front of the light fixture is achieved.

The various embodiments relate also to a method of generating light effects where the method comprises the steps of:

generating a light beam using a central illumination LED array comprises a plurality of LEDs arranged in a linear array;

illuminating an optical reflector arrange besides the linear illumination LED array using a linear pixel array comprises a plurality of individual controllable LED Pixels, where each of said LED pixels comprises a plurality of light emitters emitting different colors. As described in connection with FIG. 1A-B this makes it possible to provide a bright illumination using the central illumination LED array and also provide a visual effect at an area besides the central illumination array. The visual effect is achieved as the LED pixels illuminated an optical reflector besides the central illumination array and the reflector reflects the light forwardly and can thus been observed by person looking at the front the light fixture.

The step of illumination the optical reflector can also comprises a step of illuminating different parts of the optical reflector using different ones of the LED pixels. This makes it possible to illuminate different part of the optical reflector differently whereby dynamic illumination can be provided at the optical refactors.

We claim:

1. A light fixture, comprising:

a central illumination light emitting diode (LED) array;

at least one LED pixel array; and a first optical reflector and a second optical reflector arranged in a housing, wherein said central illumination LED array comprises a plurality of LEDs and is arranged such that light generated by said central illumination LED array is projected in a forward direction in relation to said light fixture, wherein said central illumination LED array is arranged between said first optical reflector and said second optical reflector, wherein said least one LED pixel array comprises a plurality of individual controllable LED pixels, each of said LED pixels comprising a plurality of light emitters emitting light of different colors, and said LED pixels are configured to illuminate different parts of said first optical reflector or of said second optical reflector, and wherein the first optical reflector and the second optical reflector are visible from outside a front side of the light fixture in the forward direction.

2. The light fixture according to claim 1, wherein said first optical reflector or said second optical reflector comprises a plurality of individual specular reflectors.

3. The light fixture according to claim 2, wherein said plurality of individual specular reflectors are formed as a plurality of faceted specular surfaces.

4. The light fixture according to claim 2 wherein said plurality of individual specular reflectors are formed as a plurality of specular ripples.

5. The light fixture according to claim 4, wherein one or more of said specular ripples are formed as specular dimples.

6. The light fixture according to claim 4, wherein one or more of said specular ripples are formed specular humps.

7. The light fixture according to claim 2, wherein said plurality of individual specular reflectors are arranged in a regular pattern.

8. The light fixture according to claim 1, further comprising a central light collector configured to collect light from said central illumination LED array and configured to convert the collected light into a light beam and redirect said light beam in a direction away from said first and said second optical reflector.

9. The light fixture according to claim 1, wherein said first optical reflector and said second optical reflector are arranged such that substantially no light from said central illumination LED array illuminates said first optical reflector or said second optical reflector.

10. The light fixture according to claim 1, wherein said LEDs of said central illumination LED array are arranged in a linear array, the length of said linear array is at least twice the width of said linear array, and said first optical reflector and said second optical reflector are arranged at opposite sides along the longitudinal direction of said linear array.

11. The light fixture according to claim 1, wherein at least one end reflection surface is arranged adjacent to at least one of said first optical reflector and said second optical reflector, and said end reflection surface is configured to receive at least a portion of light illuminating at least one of said first optical reflector and said second optical reflector and is arranged at a position visible from a front side of said light fixture.

12. The light fixture according to claim 11, wherein two end reflection surfaces are arranged at opposite sides of at least one of said first optical reflector and said second optical reflector, and said two end reflector surfaces are configured to face each other.

13. The light fixture according to claim 11, wherein said end reflection surface comprises a plane reflection surface.

14. A method of generating light effects, comprising:

generating a light beam using a linear illumination light emitting diode (LED) array that comprises a plurality of LEDs arranged in a linear array, wherein the light beam is projected in a forward direction in relation to a light fixture that includes the linear illumination LED array; and illuminating an optical reflector arranged along said linear illumination LED array using a linear pixel array that comprises a plurality of individual controllable LED pixels, wherein each of said LED pixels comprises a plurality of light emitters that emit light of different colors, wherein illuminating said optical reflector comprises illuminating different parts of said optical reflector with different colored light using different LED pixels, and wherein the optical reflector is visible from outside a front side of the light fixture in the forward direction.

15. The method according to claim 14, further comprising generating light effects by dynamically controlling said LED pixels.

* * * * *